US011013325B2

(12) United States Patent
Meyer et al.

(10) Patent No.: US 11,013,325 B2
(45) Date of Patent: May 25, 2021

(54) OVERHEAD DOOR STORAGE SYSTEM

(71) Applicants: John C Meyer, Gladstone, MO (US); Steven H Harmon, Leawood, KS (US); Brandon A Cusick, Kansas City, MO (US); Lisa Kauffman Kelley, Overland Park, KS (US)

(72) Inventors: John C Meyer, Gladstone, MO (US); Steven H Harmon, Leawood, KS (US); Brandon A Cusick, Kansas City, MO (US); Lisa Kauffman Kelley, Overland Park, KS (US)

( * ) Notice: Subject to any disclaimer, the term of this patent is extended or adjusted under 35 U.S.C. 154(b) by 123 days.

(21) Appl. No.: 16/017,628

(22) Filed: Jun. 25, 2018

(65) Prior Publication Data

US 2019/0387883 A1 Dec. 26, 2019

(51) Int. Cl.

| | |
|---|---|
| ***A47B 95/00*** | (2006.01) |
| ***A47B 63/00*** | (2006.01) |
| ***A47B 81/00*** | (2006.01) |
| ***E06B 7/28*** | (2006.01) |
| ***A47F 5/00*** | (2006.01) |

(Continued)

(52) U.S. Cl.

CPC ..... *A47B 95/00* (2013.01); *A47B 63/00* (2013.01); *A47B 81/005* (2013.01); *A47F 5/0006* (2013.01); *A47F 5/08* (2013.01); *A47F 5/0876* (2013.01); *A47G 25/0621* (2013.01); *E06B 7/28* (2013.01)

(58) Field of Classification Search

CPC ..... A47B 95/00; A47B 63/00; A47B 81/005; A47B 2051/005; E06B 7/28; E06B 7/00; E06C 7/505; A47F 5/0006; A47F 5/08; A47F 5/0815; A47F 7/143; A47F 5/0892; A47F 5/0807; A47F 5/0876; A47F 5/0884; A47G 25/06; A47G 25/0607; A47G 25/0614; A47G 25/0621; A47G 25/0642; A47G 25/065; A47G 25/0635; A47G 25/0685; D06F 57/12; F16M 13/02

USPC ..... 211/96, 104, 119.004, 119.009, 106.01, 211/87.01, 117, 86.01, 99, 100, 101; 248/301, 304; 160/201, 209, 127

See application file for complete search history.

(56) References Cited

U.S. PATENT DOCUMENTS 269,171 A * 12/1882 Brickley ..... A47G 25/0685 211/96
472,188 A * 4/1892 Burdge ..... A47G 25/0685 211/97

(Continued)

OTHER PUBLICATIONS https://www.fourthwallsolutions.com/products/garage-storage-garage-door-storage-hooks-rack-for-fishing-rods-paddles-garden-tools. Sep. 18, 2020. (Year: 2020).*

*Primary Examiner* — Jennifer E. Novosad
(74) *Attorney, Agent, or Firm* — Law Office of Mark Brown, LLC; Christopher M. DeBacker

(57) ABSTRACT

A storage apparatus uses the tube of an overhead door hinge to releasably attach a rack to hang storage items. The storage apparatus has a mounting hook affixed to a rigid rail and may also includes a support bracket for retaining space between the overhead door and the storage apparatus such that it remains parallel to the door when closed. An alternative embodiment includes a mounting bracket which can be attached to an overhead door and used in lieu of the hinges. Another embodiment includes a single hook which swings freely from the overhead door when mounted.

3 Claims, 8 Drawing Sheets

(51) Int. Cl.
*A47F 5/08* (2006.01)
*A47G 25/06* (2006.01)

(56) References Cited

U.S. PATENT DOCUMENTS 496,173 A * 4/1893 Smith ..... A47F 7/283 211/75
914,697 A * 3/1909 Bryant ..... A47G 7/045 248/290.1
975,273 A * 11/1910 Noppe ..... A47G 25/0685 211/97
1,170,919 A * 2/1916 McCallum ..... F16M 13/02 248/282.1
1,208,986 A * 12/1916 Krodel ..... F16M 13/02 248/282.1
1,435,110 A * 11/1922 Efford ..... A47H 5/09 211/96
1,751,691 A * 3/1930 Flath ..... A47B 57/045 248/213.1
2,054,371 A * 9/1936 Biltz ..... A47G 25/0621 211/119.004
2,128,596 A * 8/1938 Redin ..... A47B 61/02 248/213.1
2,453,919 A * 11/1948 Johnson ..... A47B 61/02 211/96
2,487,652 A * 11/1949 Heinrich ..... A47G 25/0685 211/119.004
2,492,701 A * 12/1949 Kirk ..... A47G 25/0685 211/100
2,595,521 A * 5/1952 Hanson ..... D06F 57/12 211/119.004
2,609,104 A * 9/1952 Leach ..... A47G 25/08 224/482
2,615,579 A * 10/1952 Sampson ..... A47G 25/746 211/100
2,666,530 A * 1/1954 Beren ..... A47G 25/746 211/99
2,684,225 A * 7/1954 Johnson ..... A47G 25/08 248/213.1
2,709,005 A * 5/1955 Eckstein ..... A47G 25/145 211/113
2,769,552 A * 11/1956 Seidman ..... A47G 25/0685 211/119.004
2,895,698 A * 7/1959 Palmer ..... A47G 25/08 248/213.1
2,896,791 A * 7/1959 Raber ..... A47G 25/0621 211/119.004
2,927,761 A * 3/1960 Martiello ..... A47G 25/0685 248/213.1
3,044,630 A * 7/1962 Szabo ..... A47G 25/0621 211/119.004
3,145,849 A * 8/1964 Hanson ..... A47G 25/08 211/105.1
3,175,696 A * 3/1965 Milbourne ..... A47G 25/06 211/119.004
3,200,435 A * 8/1965 Hemmeter ..... A47G 25/0685 16/223
3,294,248 A * 12/1966 Olson ..... A47G 25/0685 211/96
3,329,385 A * 7/1967 Dietsch ..... B60R 7/10 248/290.1
3,376,007 A * 4/1968 Chesterley ..... A47F 7/0042 248/285.1
3,724,677 A * 4/1973 Vogelhuber ..... A47G 25/0685 211/96
3,825,127 A * 7/1974 Morrison ..... A47G 25/0685 211/96
3,978,988 A * 9/1976 Friedeberg ..... D06F 53/04 211/113
4,501,953 A * 2/1985 Hollinetz ..... A24C 5/007 162/263
4,863,081 A * 9/1989 Gabbert ..... B60R 7/10 224/550
4,872,568 A * 10/1989 Lehmann ..... A47G 25/1457 211/113
4,972,961 A * 11/1990 Roesch ..... A47G 25/18 211/116
5,007,645 A * 4/1991 Weigl ..... A63B 63/00 273/407
5,036,899 A * 8/1991 Mullet ..... E05D 15/24 160/189
5,072,837 A * 12/1991 Rosch ..... A47G 25/18 211/116
5,078,276 A * 1/1992 Rogge ..... B62H 3/12 211/18
5,104,083 A * 4/1992 Shannon ..... B60R 7/10 211/105.1
5,107,996 A * 4/1992 Whittaker ..... A47G 25/1457 211/113
5,117,987 A * 6/1992 Lombardo ..... A47G 25/0685 211/105.1
D338,126 S * 8/1993 Callaway ..... D6/324
5,501,345 A * 3/1996 Hilstolsky ..... A47G 25/1457 211/113
5,505,317 A * 4/1996 Rulis ..... A47B 46/00 211/119.004
5,842,581 A * 12/1998 Graefe ..... B25H 1/0014 211/17
5,904,276 A * 5/1999 Chen ..... A45C 13/03 211/104
6,050,427 A * 4/2000 Loveland ..... E05D 11/00 211/119.004
6,193,084 B1 * 2/2001 Oliver ..... A47G 25/0621 211/119.004
6,276,539 B1 * 8/2001 Richbourg ..... A47B 81/005 160/327
6,722,511 B1 * 4/2004 Lowe ..... A47F 5/0838 211/119.004
6,871,749 B2 * 3/2005 Bostick ..... A47G 25/746 211/94.01
7,000,783 B2 * 2/2006 Webb ..... B62H 3/12 211/113
7,237,687 B1 * 7/2007 Abdi ..... A47G 25/0685 211/119.004
7,240,823 B1 * 7/2007 Saidiazar ..... A47G 29/12 232/19
7,588,225 B2 * 9/2009 Wawerski ..... B44D 3/14 16/425
7,908,711 B2 * 3/2011 Johnson ..... A47G 25/06 16/366
7,958,925 B2 * 6/2011 Murray ..... E06B 3/485 160/127
8,141,722 B2 * 3/2012 Heroux ..... A47G 25/1457 211/113
8,215,042 B1 * 7/2012 Kilmer ..... A47G 1/1653 248/220.1
8,540,087 B1 * 9/2013 Skaer ..... A47G 25/0685 211/100
9,463,903 B2 * 10/2016 Garrett, Sr. ..... B65D 7/06
9,560,927 B2 * 2/2017 Krumpe ..... A47G 25/0607
9,603,449 B1 * 3/2017 Evans ..... A47B 81/005
9,668,574 B2 * 6/2017 Wagner ..... A47B 81/005
9,908,023 B1 * 3/2018 Hamm ..... A63B 69/0097
9,915,096 B2 * 3/2018 Potter ..... A47F 5/01
10,258,852 B1 * 4/2019 Walker ..... A63B 69/00
D885,770 S * 6/2020 Heroux ..... D6/315
2003/0146179 A1 * 8/2003 Lowe ..... A47B 49/00 211/119.004
2005/0109721 A1 * 5/2005 Schneider ..... A47G 25/1457 211/118
2005/0273976 A1 * 12/2005 Sarver ..... E05D 15/242 16/242
2006/0038466 A1 2/2006 Morgan
2006/0038468 A1 * 2/2006 Morgan ..... A47B 96/16 312/245
2007/0029355 A1 * 2/2007 Dente, Jr. ..... A47B 61/003 223/85
2007/0272637 A1 * 11/2007 Rigas ..... A47G 25/0685 211/119.004

(56) References Cited

U.S. PATENT DOCUMENTS

| | | | | |
|---|---|---|---|---|
| 2010/0050529 | A1* | 3/2010 | Manser | E06B 9/06 49/199 |
| 2010/0108834 | A1* | 5/2010 | Rigas | A47G 25/0685 248/213.1 |
| 2011/0024376 | A1* | 2/2011 | Hendricks | A01G 5/04 211/119.004 |
| 2011/0067310 | A1 | 3/2011 | Murray | |
| 2012/0234505 | A1* | 9/2012 | Hartwig | B25H 3/00 160/127 |
| 2015/0101763 | A1* | 4/2015 | Dittmer | E05D 15/165 160/202 |
| 2016/0061380 | A1* | 3/2016 | Smith | F16M 13/022 248/558 |
| 2018/0305963 | A1* | 10/2018 | Wunderle | E05D 11/0054 |
| 2019/0387883 | A1* | 12/2019 | Meyer | A47B 63/00 |

* cited by examiner

OVERHEAD DOOR STORAGE SYSTEM

CROSS-REFERENCE TO RELATED APPLICATIONS

This application claims the benefit of provisional patent application Ser. No. 62/604,135, filed 2017 Jun. 23 by the present inventors.

BACKGROUND

The garages of homeowners and renters are notoriously cluttered as more and more items are not stored in the home due to inside storage space limitations, size, awkward shape of object, seasonality, or nature of being for outdoor use. Not only do the neighbors occasionally see this unsightly clutter, but also it can be a nuisance and danger to those walking around it. There is a need for an attractive storage system where items, and even the storage apparatus for storage one transports one's items in, can be stored and retrieved safely, quickly, and easily and that uses a previously unused storage area.

U.S. Pat. No. 7,240,823 and publication 20060038468 indicate a way that storage boxes can be attached to an overhead door panel. In both cases the storage boxes are bolted or screwed to the garage door panel, which causes it to be slow to install and remove, and requires tools for attachment. It will also damage and leave holes in the overhead door panel after removal.

U.S. Pat. No. 6,276,539 indicates a way to store fishing rods on a rack attached to an overhead door panel. These racks, like the previous prior art example, are also bolted or screwed to the overhead door panel, are also slow to install and remove, will require tools to attach, and will also damage and leave holes in the overhead door panel after removal.

The Cobra storage system rack can be bolted or screwed directly to the overhead door panel, and in some cases, the door panel trim must be bent back from the frame holding the panel and attached at that point. The Cobra storage system is a rigid device that requires tools for attachment and is slow to install and remove. If the Cobra storage system is not screwed or bolted into the panel, it can be removed without damage to the garage door panel other than a possible slight bending of the door panel trim. The Cobra rack's closed loop design requires that the most of the fishing rods and long garden tools, for which it was designed, be threaded in from the side. This is difficult and can be impossible in some single car garages.

Publication 20110067310 uses the screw, or nut and bolt hardware that attaches the overhead door hinge to the overhead door in order to attach a flat netting to an overhead door panel. This netting is not designed to be easily removable. It will be slow to install and uninstall the netting. It may be difficult to fit the netting correctly without it being custom made. The reason it may need to be custom made is that it is up to each garage door installer to decide how many sets and how far apart horizontally the overhead door hinges are installed on an overhead door so there is no set length between the hinges to which the netting attaches itself.

Publication 20120234505 uses the outside of the overhead door hinge's pivoting horizontal cylinder to loop flexible strapping between two vertical hinges. This strapping also contains loops of strap for one to slide in fishing rods. The attachment method, though a little faster than the other options, still will take some time to thread and then loop each end through the hinges, and then hold the strap in place while tightening the strap through the fastener. The strapping lacks the sturdiness and clean appearance of more rigid racks. In addition, the strapping is very difficult to thread a fishing rod through. Also, threading in from the side, in some single car garages, is impossible.

We have found each prior art example mentioned above has weak or non-existent features:

a. Prior art examples manner of attaching their device to the garage door makes it difficult to attach easily or quickly.
b. Prior art examples use loops to hold storage items. It is difficult, cumbersome and time consuming to thread storage items through loops because it requires coming in from the side. Coming in from the side for some tools, sports equipment, and fishing rods in some small garages is not possible due to the space limitations.
c. Prior art of rigid storage systems all require tools for installation and damage the overhead door panel.
d. Prior art examples require multiple steps and considerable time to produce each unit so it increases the cost of their manufacturing and their consumer sale price

SUMMARY

In accordance with one embodiment is a system of storing objects on an overhead door by connecting to at least to one hinge of an overhead door a storage apparatus that can transport or hold storage items, that can quickly and easily be attached without using tools and the storage item the apparatus stores can quickly and easily be loaded and unloaded.

Advantages

According several advantages of one or more aspects of the overhead door storage system are as follows: to provide an easy to manufacture apparatus for attaching storage items for storage to an overhead door, without damaging the overhead door, in a way that is easy and quick to install and remove, takes advantage of unused storage space, and to have a apparatus from which it is easy and quick to store or to retrieve storage items.

DRAWINGS—FIGURES

In the drawings, closely related items have the same last two digits in the number.

Figure 3A:
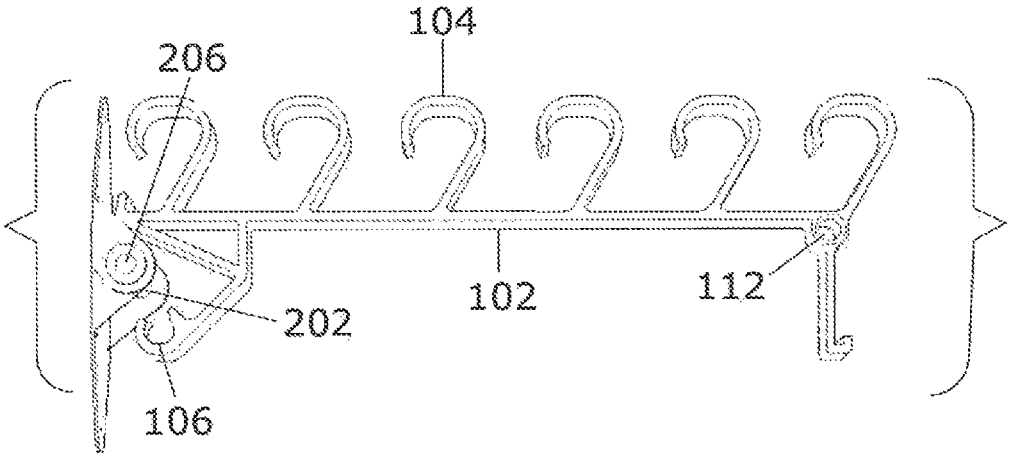

FIG. 3*a* shows the apparatus for storage of FIG. 1 positioned just below an overhead door hinge ready to be installed.

Figure 1:
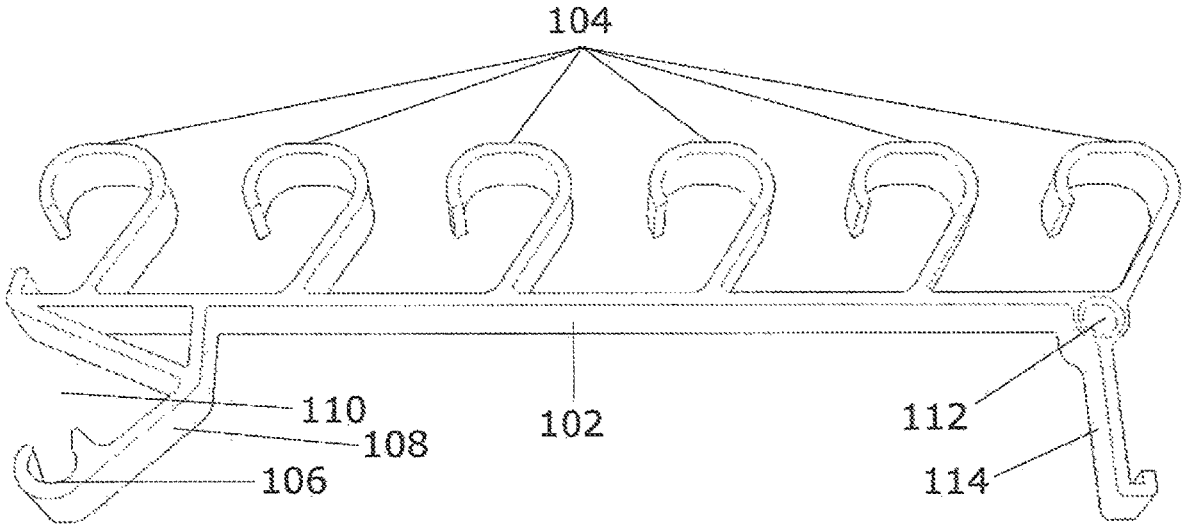
FIG. 1 shows one embodiment of an apparatus for storage that can be attached to at least one overhead door hinge in accordance with one embodiment.
Figure 3B:
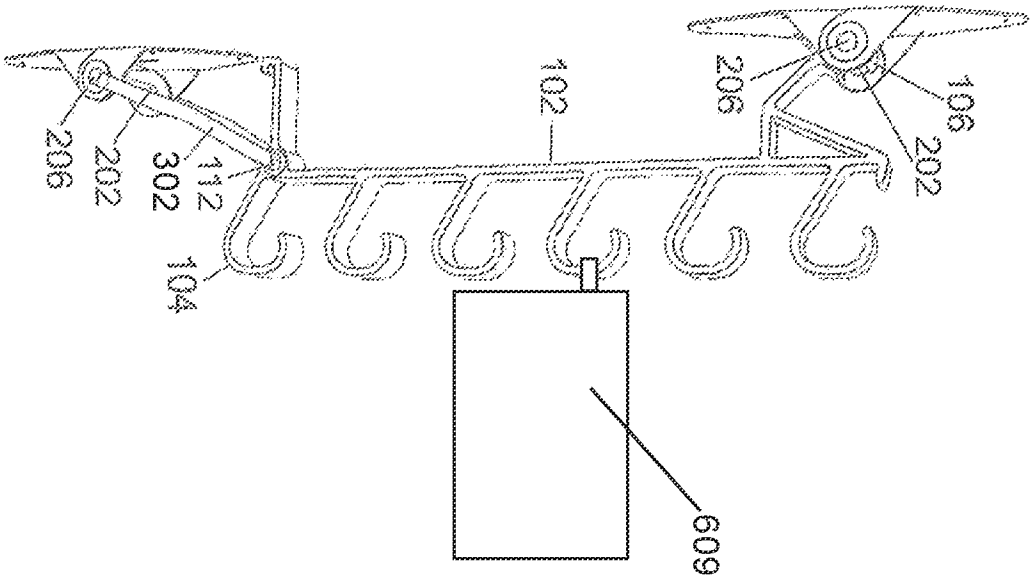

FIG. 3*b* shows the apparatus for storage of FIG. 1 attached directly to the overhead door hinges in accordance with one embodiment of FIG. 1 and includes the second apparatus for storage with long handled tools and rods shown next to it.

Figure 4:
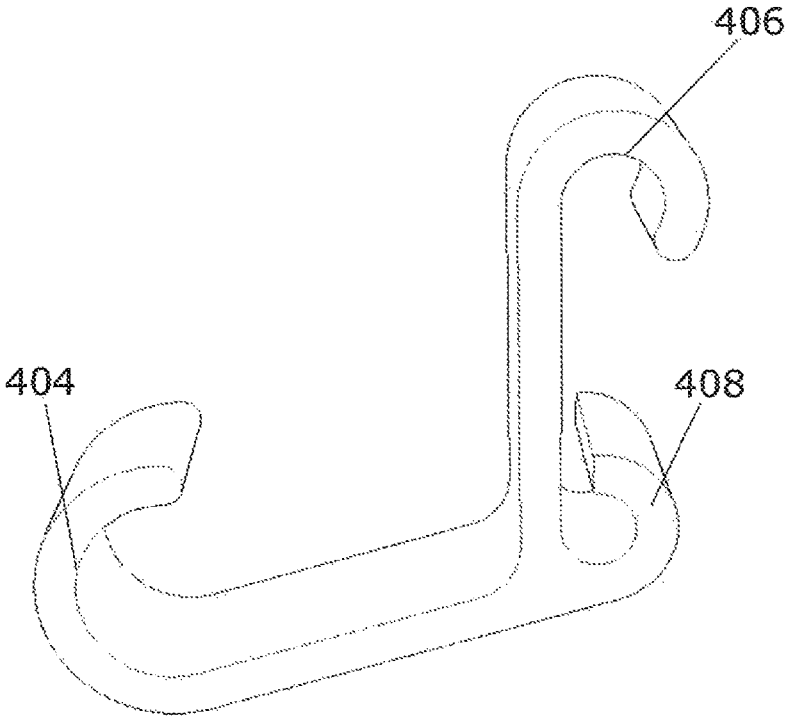

FIG. 4 shows one embodiment of a single overhead door storage hook.

Figure 5:
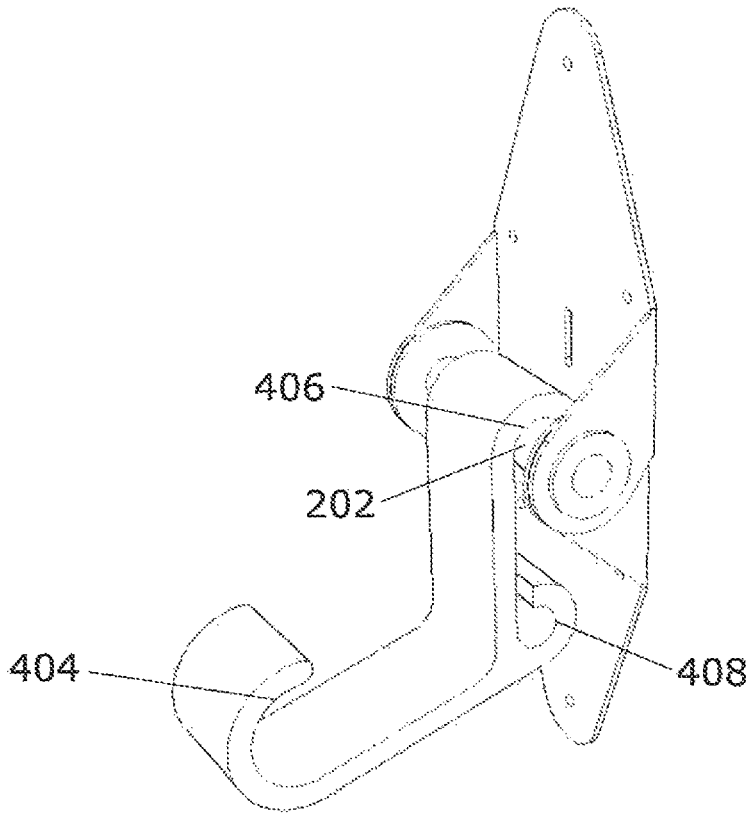

FIG. 5 shows the single overhead door storage hook of FIG. 4 mounted on the overhead door hinge.

Figure 6:
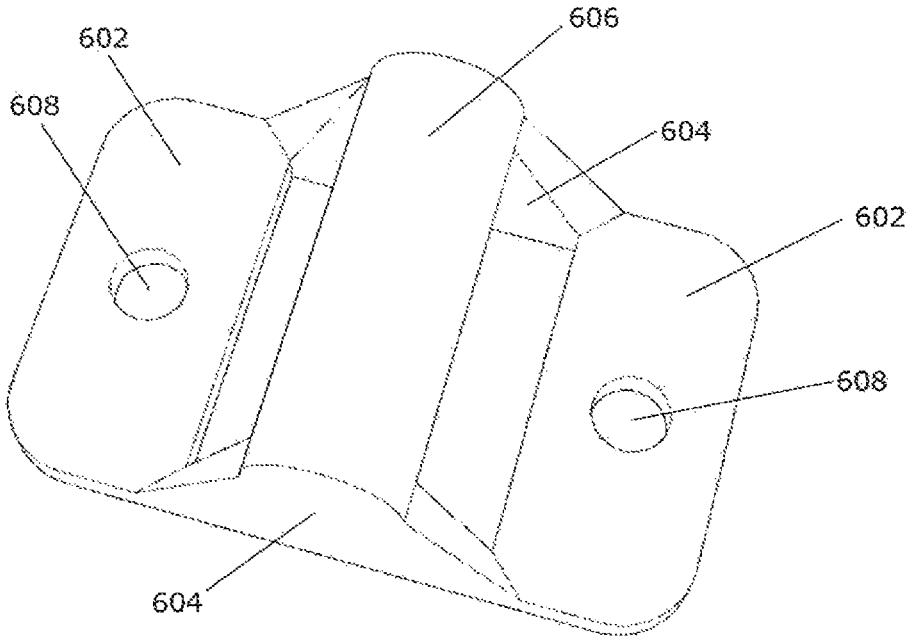

FIG. 6 shows one embodiment of a mounting bracket.

Figure 7:
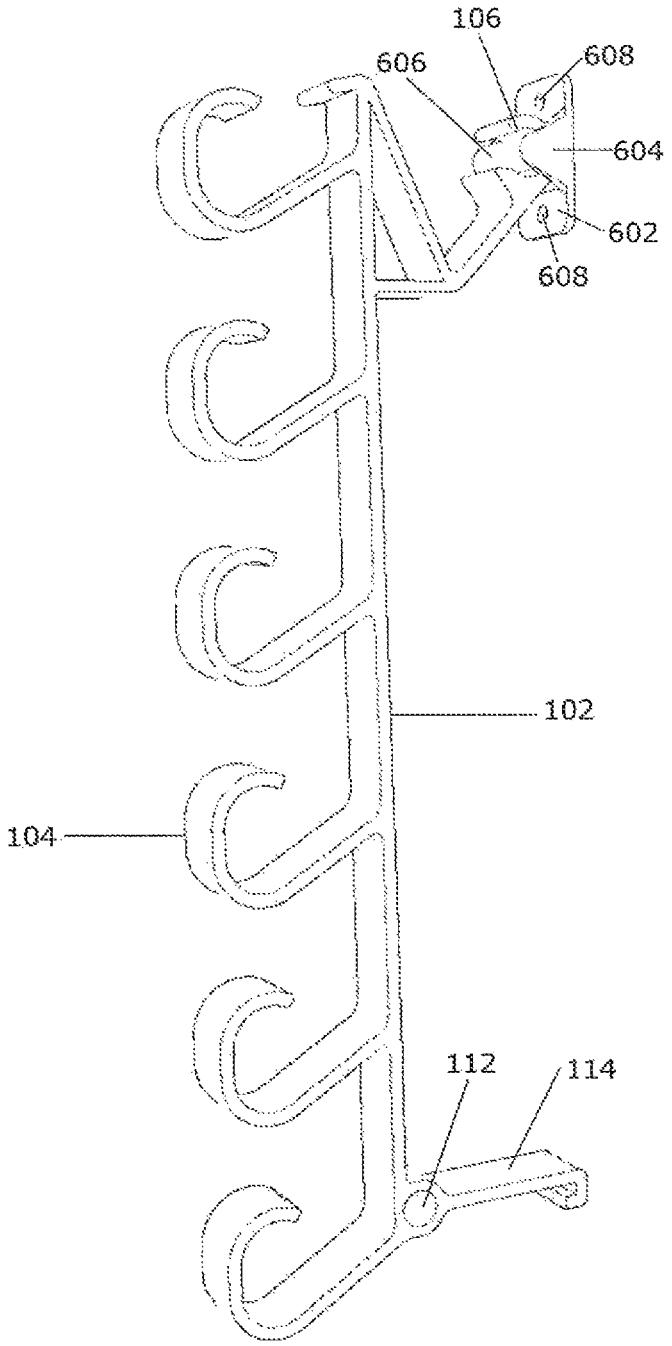

FIG. 7 shows the mounting bracket of FIG. 6 with the apparatus for storage of FIG. 1 attached.

Figure 2:
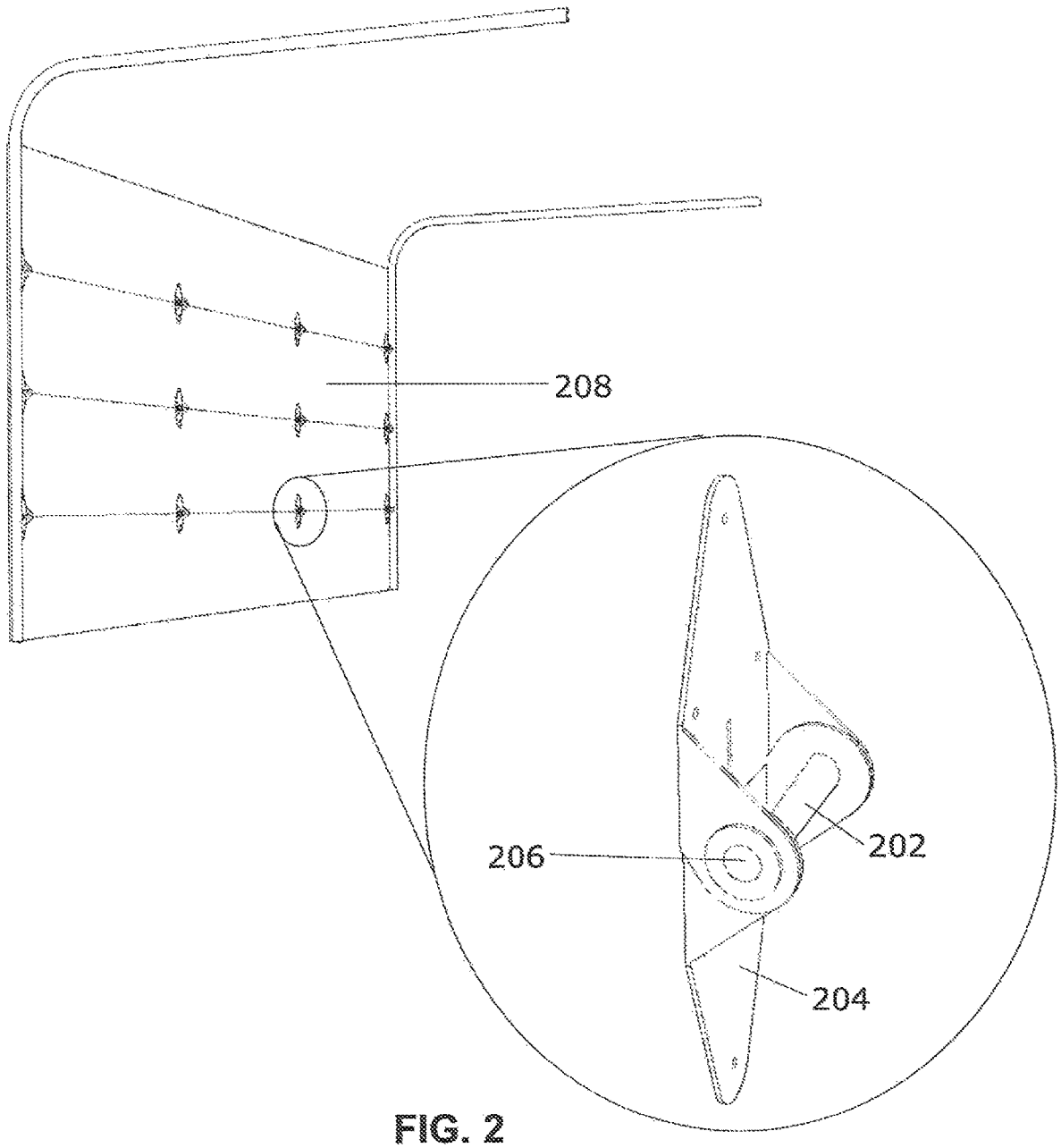
FIG. 2 shows an overhead door with an overhead door hinge that has a hollow tube.

DRAWINGS—REFERENCE NUMERALS 102 plastic rail
104 storage hooks
106 mounting hook
108 mounting hook support bracket
110 cavity
112 attachment loop
114 support bar
202 overhead door hinge tube
204 overhead door hinge base
206 overhead door hinge tube's hollow core
208 overhead door
302 attachment item
404 storage item hook
406 mounting hook
408 alignment hook
602 bracket base
604 bracket support
606 bracket tube
608 bracket mounting hole
609 storage item or object DETAILED DESCRIPTION—FIG. 1, FIG. 2, and FIG. 4—FIRST EMBODIMENT One embodiment of the overhead door storage system is illustrated in FIG. 1. An apparatus for storage of FIG. 1 has multiple storage hooks 104 along a rail 102 configured for holding storage items 609 in the vertical and horizontal position when mounted on an overhead door hinge as illustrated in FIG. 2 on an overhead door 208 also illustrated in FIG. 2 The storage hook 104 opening is a size configured for storing storage items from a list of storage items or objections 101 including fishing rod handles, sporting goods handles, kayak paddles, garden tool handles, and much more.

The storage hook 104 is configured with enough curl that storage items cannot fall out due to gravitational pull when the overhead door is up and the rail 102 is in a horizontal position with the storage hooks 104 of FIG. 1 hanging down. In this embodiment, at the top end and on the opposite side of the rail 102 as the side of the storage hook 104, is a mounting hook 106 configured for attaching the rail 102 to an overhead door hinge tube 202. The opening to the mounting hook 106 of FIG. 1 is configured to be a size that the mounting hook 106 can be hooked over the overhead door hinge tube 202 of the overhead door hinge of FIG. 2. The opening to the mounting hook 106 of FIG. 1 is configured to be angled to allow it to be hooked over the overhead door hinge tube 202 when the rail 102 is less than horizontal the apparatus for storage of FIG. 1 cannot fall off due to the mounting hook 106 stopping the gravitational downward pull. Additionally the design of the mounting hook 106 of FIG. 1 is configured in such a way that, once it is hooked, it is allowed to swing freely around the overhead door hinge tube 202 of FIG. 2 but cannot slide off due to the lack of space between the overhead door hinge tube 202 and an overhead door hinge base 204 of FIG. 2.

The mounting hook 106 of FIG. 1 is attached to the rail 102 using a mounting hook support bracket 108 configured to create a cavity 110 that allows the apparatus for storage of FIG. 1 to move with the overhead door without interference from a higher overhead door panel or the overhead door hinge when the overhead door is raised or lowered.

In this embodiment of FIG. 1 at the lower end of the rail 102 is an attachment loop 112 as shown in FIG. 1 configured for attaching the rail 102 to the overhead door by threading attachment items from a group of attachment items that includes cable ties, cable, rope, string, cord, belt, tape, or other attachment items (many not shown) 302 of FIG. 3*b* to secure the lower end of the rail 102 to the overhead door.

Also in this embodiment of FIG. 1 at the lower end of the plastic rail 102 and on the opposite side from the storage hooks 104 is a support bar 114 configured to be of such a length to can keep the rail 102 vertical when the overhead door is down. This support bar 114 of FIG. 1 also keeps the rail 102 parallel to the overhead door panel when the cable tie or other attachment item 302 of FIG. 3*b* is treaded through the attachment loop 112 and attached to the overhead door panel. In this embodiment of the rail 102, the support bar 114 of FIG. 1 is configured to a length longer than the width of a three inch hurricane strut (not shown) used on some overhead doors for stabilization against hurricanes and strong winds. The distance of the furthermost edge of the mounting hook 106 of FIG. 1 to the rail 102 should also be of the same length of the support bar 114 to keep the rail horizontal to the overhead door panel, and not interfere with any three inch hurricane strut, when a cable tie or other attachment item 302 of FIG. 3*b* is threaded through the attachment loop 112 and attached to the overhead door panel.

Operation—FIGS. 1, 2, 3*a*, and 3*b*

The manner of using the overhead door storage system in one embodiment of FIG. 1 is to attach one apparatus for storage of FIG. 1 each to two overhead door hinges that are horizontal to each other on the overhead door panel as a way to hold storage items from a list of storage items including fishing rods, kayak paddles, garden tools, and other items.

The apparatus for storage of FIG. 1 is attached to the overhead door hinge of FIG. 2 by positioning the rail 102 at approximately a 90 degree horizontal angle to the overhead door and aligning the mounting hook 106 directly under the overhead door hinge tube 202 of FIG. 2 as shown in FIG. 3*a* and then moving the rail 102 upwards until the mounting hook 106 is hooked on the overhead door hinge tube 202. Next reduce the angle of the rail 102 to vertical as shown in FIG. 3*b* and the apparatus for storage of FIG. 1 will be secured by the mounting hook 106 to an upper overhead door hinge tube 202 by gravity. One then has the option of letting the apparatus for storage of FIG. 1 swing free as the overhead door goes up and down, or attaching the lower end of the rail 102 to lower overhead door by using the attachment 302 of FIG. 3*b* through the attachment loop 112 and then, in one embodiment, around the tube of a lower overhead door hinge 202 of FIG. 2 (not shown) OR then through the hollow tube of the lower overhead door hinge 206 of FIG. 2 or as shown in FIG. 3*b*. If the lower end of the rail 102 is attached to a lower overhead door hinge it does creates more clearance for the apparatus for storage of FIG. 1 over vehicles parked under the overhead door when the overhead door is in the up position.

With two apparatuses for storage now installed on an overhead door it is easy to load long storage items from a group of long storage items (not shown) that includes fishing rods, sporting goods, garden tools, and kayak paddles directly onto the apparatus for storage of FIG. 1 using, in one embodiment, the storage hooks 104. This is done by loading the long storage item in from the front and not by threading the handles of the long storage items in from the side. These long storage items then ride up and down with the overhead door without falling when the overhead door is raised.

FIG. 1—Alternative Embodiments

In other embodiments the apparatus for storage of FIG. 1 could be made of any combination of conventional rigid materials including plastic, metal, wood, rubber, vinyl, polyurethane or other rigid materials.

In other embodiments the apparatus for storage of FIG. 1 could be configured with a small amount of draft angle so that it can quickly and inexpensively be produced by a single simple two-part straight pull injection mold.

In other embodiments the apparatus for storage of FIG. 1 could have one hook as shown in FIG. 4, or multiple storage hooks 104 as shown in FIG. 1.

In other embodiments of the apparatus for storage of FIG. 1, there could be a single storage hook 104 that is elongated and configured to be large enough to store larger storage items from a group of larger storage items including snow skis, water skis, ladders, paddleboards, and other large items (not shown).

In other embodiments the apparatus for storage of FIG. 1 could attach storage items from a group of ways to attach storage items including clips, rings, straps, clamps, pins, carabineers, hook and loop fasteners, belts, clips, chests, bags, boxes, or cases (not shown).

In other embodiments the apparatus for storage of FIG. 1 could be attached to the overhead door by utilizing the overhead door hinge tube's hollow core 206 of FIG. 2 and connecting it to the apparatus for storage of FIG. 1 by using a means of attachment from a list of means of attachment including hooks, rings, straps, clamps, pins, carabineers, hook and loop fasteners, belts, cables, rope, cables, cable ties, or clips (many not shown).

In other embodiments the apparatus for storage of FIG. 1 could be attached to the overhead door by utilizing the overhead door hinge tube 202 of FIG. 2 and connecting it to the apparatus for storage of FIG. 1 by using a clipping attachment that is selected from a group of clipping attachments that includes clamps, carabineers, reusable cable ties, or clips (not shown).

In other embodiments the apparatus for storage of FIG. 1 could have an attachment that is releasably attached to the overhead door hinge. Thus the apparatus for storage would be portable, quick, and easy to remove from the overhead door to transport the apparatus for storage of FIG. 1 and it's storage items in a vehicle or other location. All then can be easily attached later at the same location or at a different location.

DETAILED DESCRIPTION—FIG. 4—SECOND EMBODIMENT

One embodiment of the overhead door storage system is illustrated in FIG. 4. A mounting hook 406 shown in FIG. 4 is configured to hook on the overhead door hinge tube 202 of FIG. 2 and swing freely as an overhead door is raised and lowered without hindrance from any part of the rest of the overhead door hinge or it's hardware. In this embodiment a storage hook 404 is configured to have enough curl to keep storage items from falling off when the overhead door goes up and down.

The opening to the mounting hook 406 of FIG. 4 is configured to be of a size that the mounting hook 406 can be hooked over the overhead door hinge tube 202 of FIG. 2. This embodiment also includes an alignment hook 408 as seen in FIG. 4. The alignment hook 408 is configured to be of a size to align the storage hook 404 away from the base of the overhead door hinge 204 of FIG. 2 to better store the storage items.

Operation—FIGS. 4, and 5

The manner of using the overhead door storage system in one embodiment of FIG. 4 is to attach the mounting hook 406 of FIG. 4 to the overhead door hinge tube 202 of FIG. 2 as shown in FIG. 5.

The storage hook 404 of FIG. 4 is configured to hang items to be stored from a group of items to be stored including bag straps, cables, rope, handles, rings, clips, belts, cords, caps, bags, rods, poles, wire, paint cans and other items to be stored (not shown) in such a way that storage items do not fall off when the overhead door is raised or lowered.

The alignment hook 408 and the mounting hook 406 of FIG. 4 can also be used for hanging items to be stored from a group of items to be stored including cables, rope, handles, rings, clips, belts, cords, wire, and other items to be stored (not shown).

Alternative Embodiments

In other embodiments of the overhead door storage hook of FIG. 4, the storage hook could be made of any combination of rigid materials including plastic, metal, wood, rubber, vinyl, polyurethane or other rigid materials.

In other embodiments of the overhead door storage hook of FIG. 4 the storage hook could be configured to fit larger storage items from a group of larger storage items including paddleboards, golf bags, snow skis, water skis, and other larger storage items (not shown).

In other embodiments the overhead door storage hook of FIG. 4 the storage hook could be configured with draft and quickly and inexpensively produced by a two part straight pull injection mold.

DETAILED DESCRIPTION—FIG. 6—THIRD EMBODIMENT

One embodiment of the overhead door storage system illustrated in FIG. 6 is a bracket for attaching the apparatus for storage of FIG. 1 to the hardware of the overhead door that includes nuts, bolts, screws, hinge, and overhead door panel trim (all not shown) of the overhead door (not shown). The bracket of FIG. 6 with a bracket base 602 has bracket supports 604 configured to hold a bracket tube 606 at approximately the same height as the overhead door hinge tube 202 as in FIG. 2 with clearance configured under the bracket tube 606 to the bottom of the bracket base 602 of FIG. 6 so that the mounting hook 106 of FIG. 1 can be hung on the bracket tube 606. The bracket tube 606 is configured to be approximately the same diameter as the overhead door hinge tube 202 as in FIG. 2. The bracket base 602 of FIG. 6 has mounting holes for mounting to the hardware of the overhead door.

Operation—FIGS. 6, and 7

The manner of using the overhead door storage system mounting bracket of FIG. 6, in one embodiment, is to attach the mounting bracket of FIG. 6 by using a mounting hole 608 of the mounting bracket of FIG. 6 to attach the mounting bracket of FIG. 6 to the hardware of the overhead door (not shown) using hardware attaching items from a group of hardware attaching items including screws, nuts or bolts (not shown) in a way that the apparatus for storage of FIG. 1 can be attached to the mounting bracket of FIG. 6 as shown in FIG. 7.

Alternative Embodiments

In other embodiments of the overhead door storage system the mounting bracket of FIG. 6 could be attached to a wall or a ceiling such that the apparatus for storage of FIG. 1 could be attached anywhere without the need of an overhead door.

In other embodiments of the overhead door storage system the mounting bracket of FIG. 6 could be made of any combination of rigid materials including plastic, metal, wood, rubber, vinyl, polyurethane or other rigid materials.

In other embodiments the mounting bracket of FIG. 6 could be configured with draft and quickly and inexpensively produced by a simple two part straight pull injection mold.

Advantages

From the description above, a number of advantages of some embodiments of our overhead door storage system become evident:

(a) There is an advantage in using an apparatus for storage that can store storage items configured to hook on an overhead door hinge tube because it can simply, quickly and easily be installed and removed without tools.

(b) There is an advantage in using an apparatus for storage that can store storage items configured to clip on an overhead door hinge tube because it can simply, quickly and easily be installed and removed without tools.

(c) There is an advantage in using an apparatus for storage that uses a rigid hook, open end clip, carabineer, or other rigid removable attachment apparatus for attaching to the overhead door hinge tube because it can be more quickly and easily be installed and removed than a storage apparatus that utilizes a flexible more permanently attached loop.

(d) There is a clear advantage in using hooks to a attach long storage item to an overhead door because of the ease of directly and quickly storing and removing long storage item like fishing rods, garden tools, and kayak paddles rather than having to thread them in through a loop from the side as is such in all the prior art overhead door storage devices. The surprising thing is considering using hooks on an overhead door because the overhead door, and hence the storage device, changes from vertical to horizontal and hangs, secured only by gravity overhead.

(e) There is an advantage in having a product that can be made out of large choice of sturdy materials.

(f) There is an advantage in having a product that attaches to an overhead door's hardware in many ways without damaging the overhead door.

(g) There is an advantage of making future storage hooks made specifically for one type of item that requires storing.

(h) There is an advantage in designing an apparatus for storage that can be more inexpensively manufactured using just a simple straight pull injection mold.

(i) There is an advantage in using a hook for storing storage items as it is so much more versatile, can accommodate a larger range of items, and is quick and easy to use.

(j) There is an advantage in having a mounting bracket that allows the overhead door storage apparatus for storage to be stored using the overhead door's hardware when the overhead door hinge's tube is not available or ideal for use.

(k) There is an advantage in having a mounting bracket that can be attached anywhere so the overhead storage apparatus can store items, not just on an overhead door, but instead on walls and ceilings anywhere.

(l) There is an advantage in having the hooks of the apparatus for storage releasably attachable so that they can be removed with a storage item, be removed to allow more room for larger storage items on the apparatus for storage, or be removed so they can be replaced with a different kind of storage attachment apparatus.

(m) There is an advantage in designing the apparatus for storage so that it aligns vertically with the other storage apparatus on each side of the overhead door so when the overhead door is in vertical position the items visibly hang correctly aligned and so when the overhead door is moving into it's horizontal position that it has enough clearance over an apparatus for storage under it to insure the hooks stay apart and do not collide at any angle that occurs as the overhead door moves from vertical to horizontal and that at all times items that are stored on the apparatus cannot fall out.

CONCLUSIONS, RAMIFICATIONS, AND SCOPE

Accordingly, the reader will see that the overhead door storage system's various embodiments for storing garage storage items can be attached attractively, easily and quickly to the overhead door hardware and just as easily removed without damage to the overhead door or it's hardware. It is also easy and quick store and remove storage items Furthermore, the garage storage system has the additional advantages in that

- it permits the storage of items in a previously unused area, thereby freeing up space that can be used for something else.
- it is lightweight and it can be installed in seconds without any tools to conveniently store awkward and difficult items off the floor that can be a hindrance and danger to be around.
- it displays items like fishing rods and kayak paddles to be enjoyed and viewed on each trip into the garage.
- it creates a place to store items that can be transported inside a car or in the trunk of a car that is very close and handy to load and unload and replaced on the original overhead door or transported with the storage items to a another garage door.

Although the description above contains may specificities, these should not be construed as limiting the scope of the embodiments, but as merely providing illustration of some of the embodiments.

Thus the scope of the embodiments should be determined by the appended claims and their legal equivalents, rather than by the examples given.

We claim:

1. A storage system for use with an overhead door, the storage system being monolithic and consisting essentially of:

a storage apparatus comprising a rigid rail having a plurality of storage elements, and a mounting hook;

said mounting hook located at a proximal end of said rigid rail configured to be connected to a first hinge tube affixed to an overhead door, said overhead door being configured to be transitioned from a first, closed and vertical orientation to a second, open and horizontal orientation;

said mounting hook configured to be connected to said first hinge tube and hang said storage apparatus via gravity, whereby said storage apparatus swings freely as said overhead door is transitioned from said first, closed and vertical orientation to said second, open and horizontal orientation;

a support bar located at a distal end of said rigid rail, said support bar configured to retain said storage apparatus a fixed distance away from said overhead door when said overhead door is in said first, closed and vertical orientation such that said rail is parallel with said overhead door;

said rigid rail comprising a fixed length between said mounting hook and said support bar such that said storage apparatus does not pivot or rotate along said fixed length of said rigid rail;

an object connected to at least one of said plurality of storage elements such that said object remains in place within said storage apparatus when said overhead door is transitioned from said first, closed and vertical orientation to said second, open and horizontal orientation.

2. The storage system of claim 1, wherein said plurality of storage elements comprise hooks.

3. The storage system of claim 1, wherein said storage system is produced using a single cavity two-part straight pull injection mold.

* * * * *